US008428492B2

(12) United States Patent
Lui

(10) Patent No.: US 8,428,492 B2
(45) Date of Patent: Apr. 23, 2013

(54) CONNECTION ASSEMBLY OF PHOTO-CONDUCTOR DRUM

(75) Inventor: Pui-Kuong Lui, New Territories (HK)

(73) Assignee: Techno Enterprise Limited, New Territories (HK)

( * ) Notice: Subject to any disclaimer, the term of this patent is extended or adjusted under 35 U.S.C. 154(b) by 315 days.

(21) Appl. No.: 12/873,419

(22) Filed: Sep. 1, 2010

(65) Prior Publication Data

US 2012/0051787 A1 Mar. 1, 2012

(51) Int. Cl.
*G03G 15/00* (2006.01)

(52) U.S. Cl.
USPC ..... 399/167

(58) Field of Classification Search ..... 399/88, 399/90, 116, 117, 159, 167; 403/359.1; 464/160, 464/182
See application file for complete search history.

(56) References Cited

U.S. PATENT DOCUMENTS 6,725,004 B2 * 4/2004 Ahn et al. ..... 399/117
6,892,042 B2 * 5/2005 Jang et al. ..... 399/167
7,228,090 B2 * 6/2007 Toso et al. ..... 399/167

* cited by examiner

*Primary Examiner* — Hoan Tran
(74) *Attorney, Agent, or Firm* — Rosenberg, Klein & Lee

(57) ABSTRACT

A connection assembly of the photo-conductor drum is applied for linking a driving shaft. The connection assembly of the photo-conductor drum includes a drum gear and a connector. A first connection part arranged at an end of the drum gear. An end of the connector forms a second connection part corresponding to the first connection part. Another end of the connector forms a joint end. The joint end includes a central pillar, and a plurality of protrusions extending from a periphery of the central pillar. The second connection part could detachably connect to the first connection part. The joint end is detachably connected to the driving shaft. Therefore, by replacing the damaged drum gear or damaged connector only, the costs, quantity of the waste and the maintenance expend would be reduced.

8 Claims, 3 Drawing Sheets

CONNECTION ASSEMBLY OF PHOTO-CONDUCTOR DRUM

BACKGROUND OF THE INVENTION

1. Field of the Invention

The present invention provides a connection assembly of a photo-conductor drum. A connection assembly is particularly utilized on image forming for connecting a photo-conductor drum and a drive shaft.

2. Description of Related Art

The photo-conductor drum is mainly applied to an image forming device. According to FIG. 1, a conventional photo-conductor drum 1*a* and a drive shaft 2*a* is illustrated. A triangle groove 21*a* locating at center of the drive shaft 2*a*. The photo-conductor drum 1*a* with a drum gear 11*a* contains a protruding part 12*a* which could be perfectly fitted into the triangular groove 21*a*.

The drum gear 11*a* and the protruding part 12*a* are integrally formed in one piece. However, the abrasion speed of the drum gear 11*a* is different from the abrasion speed of the protruding part 12*a*. Thus, whole part of the photo-conductor drum 1*a* has to be replaced either drum gear 11*a* or the protruding part 12*a* is damaged.

SUMMARY OF THE INVENTION

The objective of the present invention is to disclose a connection assembly of a photo-conductor drum. The present invention provides a solution to reduce the manufacturing cost, decrease the quantity of waste and save the maintenance expense by replacing the abrasion part only. The present invention further provides a solution for reducing friction between the connector and the driving shaft in order to increase the productivity.

In order to achieve the aforementioned objectives, a connection assembly for linking a driving shaft of the photo-conductor drum according to the present invention is disclosed. The connection assembly of the photo-conductor drum includes a drum gear having a first connection part and a connector. The first connection part is located at one end of the drum gear. The other end of the connector is a second connection part corresponding to the first connection part. The second connection part could inlay into the first connection part and another end of the connector is a joint end which could inlay into the driving shaft. The joint end includes a central pillar, and a plurality of protrusions extending from a periphery of the central pillar.

The present invention has following benefits.

(1) Costs reduction: the drum gear and connector in accordance with the present invention are two separate and individual pieces. Therefore, during the manufacture process, the defective drum gear or defective connector could be separately replaced instead of replacing both of the defective drum gear and the defective connector. Then, the cost would be reduced.

(2) Waste reduction: either the damaged drum gear or connector needs replacement. Then, it will prevent from generating too much disposals, which is benefits to environment.

(3) The maintenance expense can be saved: the detachable drum gear and the detachable connector are designed as two individual components according to different abrasion speed. Thus, users can just replace either the damaged drum gear or connector without replacing entire photo-conductor drum unit. Thus, the maintenance expense can then be minimized.

(4) Quick assembly: The friction area between the protrusions of the connector and the driving shaft would be smaller to facilitate quick assembly.

In order to have further understanding regarding to the present invention, the following embodiments are provided along with illustrations to facilitate the disclosure of the present invention.

DETAILED DESCRIPTION OF THE PREFERRED EMBODIMENTS

Figure 1:
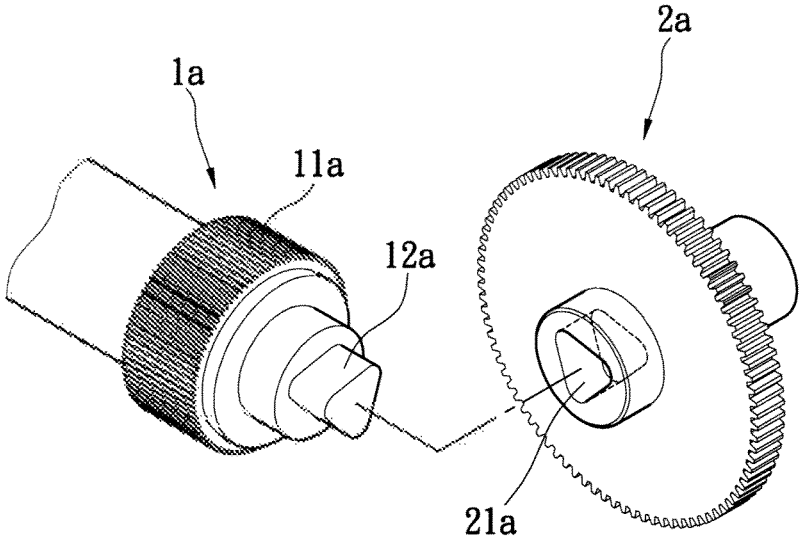
FIG. 1(PRIOR ART)
FIG. 1 shows a decomposition view of a conventional photo-conductor drum and a drive shaft.
Figure 2:
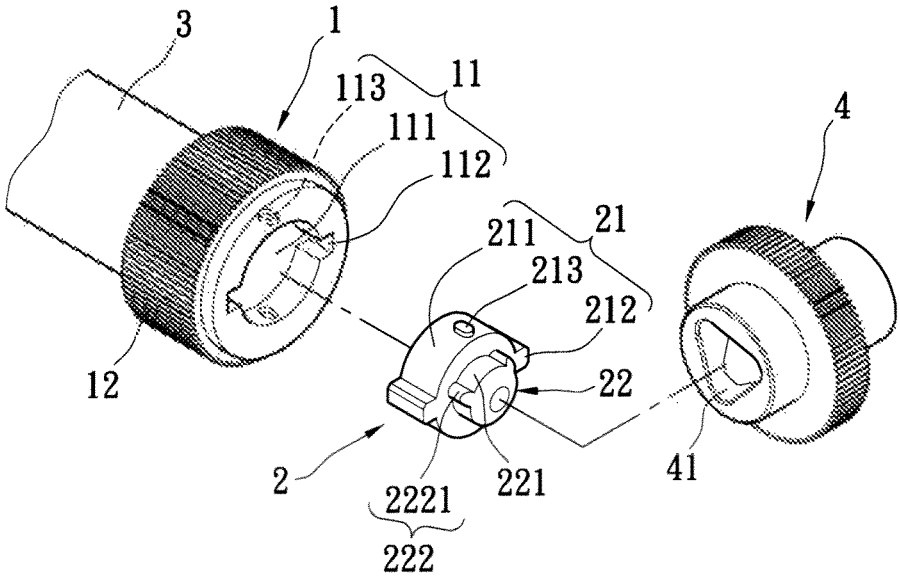
FIG. 2 shows a decomposition view of the inlay and clamp mechanism for the connection assembly in accordance with the first preferred embodiment according to the present invention.
Figure 5:
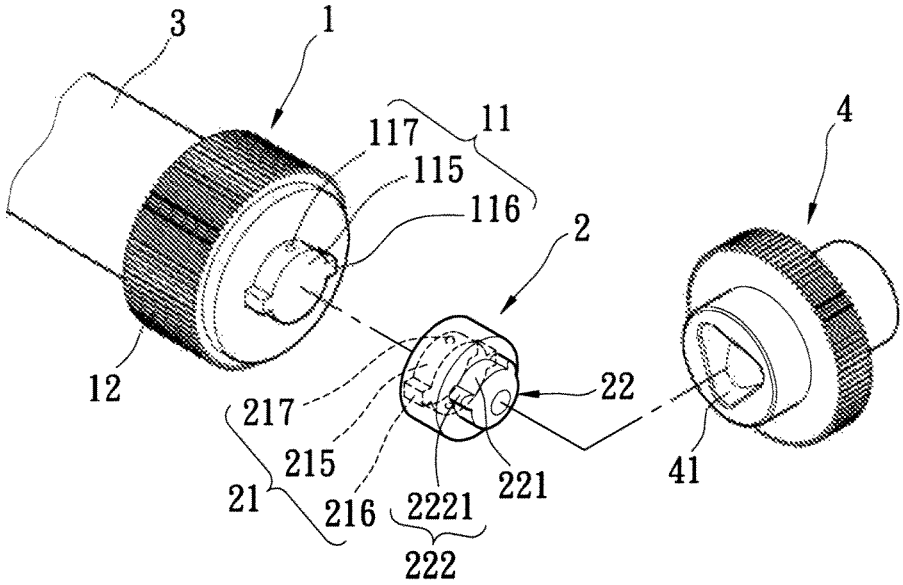
FIG. 5 shows a perspective view of the inlay and clamp mechanism for the connection assembly in accordance with the second preferred embodiment according to the present invention.

Now refer to FIGS. 2 and 5, in which a connection assembly of a photo-conductor drum in accordance with a first preferred embodiment according to the present invention is disclosed. The connection assembly of a photo-conductor drum includes a drum gear 1 and a connector 2 inlayed into an end of the drum gear 1. An opposite end of the drum gear 1 is inlayed into a photo-conductor drum 3. The connector 2 is connected to a drive shaft 4. The drum gear 1 is inlayed into the photo-conductor drum 3. Alternatively, the drum gear 1 is integrally formed with the photo-conductor drum 3.

The drum gear 1 includes a first connection part 11 and a circular gear 12 which connected to the first connection part 11. The first connection part 11 is arranged at an end of the drum gear 1, and the first connection part 11 defines a groove 111. The groove 111 is dented from an end face of the first connection part 11. The circular gear 12 is arranged at an opposite end of the drum gear 1. The circular gear 12 is sleeved onto the opposite end of the first connection part 11, or the circular gear 12 is integrally made with the first connection part 11 in one piece.

The connector 2 includes a second connection part 21 arranged at an end and correspondent with an end of the first connection part 11. The second connection part 21 is inlayed into the end of the first connection part 11. The second connection part includes a pillar 211 fitted into the groove 111 of the first connection part 11. In this case, the appearance of the pillar 211 and the groove 111 could be other type of shapes.

The connector 2 includes a joint end 22 located at another end. The joint end 22 includes a central pillar 221, and a plurality of protrusions 222 extending from a periphery of the central pillar 221. The drive shaft 4 defines a pivotal groove 41 at the center of an end, and the joint 22 of the connector 2 inserts into the pivotal groove 41 and outer peripheries of the protrusions 222 abut against a lateral wall of the pivotal groove 41. In this case, the pivotal groove 41 is configured as triangular, but not refrained.

Furthermore, the protrusions 222 are a plurality of spherical protrusions 2221. The joint 22 of the connector 2 inserts into the pivotal groove 41 and outer peripheries of the spherical protrusions 2221 abut against the lateral wall of the pivotal groove 41. Therefore, the friction area between the spherical protrusions 2221 of the connector 2 and the driving shaft 4 would be smaller, so that the connector 2 could easily insert into the driving shaft 4 for achieving the goal of quick assembly. Besides, in this case, the number of the spherical protrusions 2221 is configured as three but not limited.

The first connection part 11 and the second link portion 21 in accordance with the preferred embodiment is illustrated but not refrained.

As shown in FIG. 2, the first connection part 11 defines a groove 111, and two clamp slots 112 communicating with the groove 111. The clamp slots 112 are dented from an inner circular face, which is defined for encircling the groove 111, and the depth of the each clamp slot 112 is as same as that of the groove 111. The second connection part 21 includes a pillar 211, and two clamp projections 212 extending from outer face of the pillar 211. The pillar 211 corresponds to the groove 111, and the clamp projections 212 corresponds to the clamp slots 112. Therefore, the first connection part 11 and the second connection part 21 could clamp with each other. Besides, the quantity of the clamp slot 112 or the clamp projection 212 could be one or more.

The first connection part 11 further includes two inlay slots 113 communicating with the groove 111. The inlay slots 113 are located between the two clamp slots 112 and dented from the inner circular face, which is defined for encircling the recess 111. The second connection part 21 further includes two inlay projections 213 extending from outer face of the pillar 211. The inlay projections 213 correspond to the inlay slots 113. The inlay projections 213 could be bumps or hooks. Therefore, the first connection part 11 and the second connection part 21 could hook up with each other for better connection.

Figure 3:
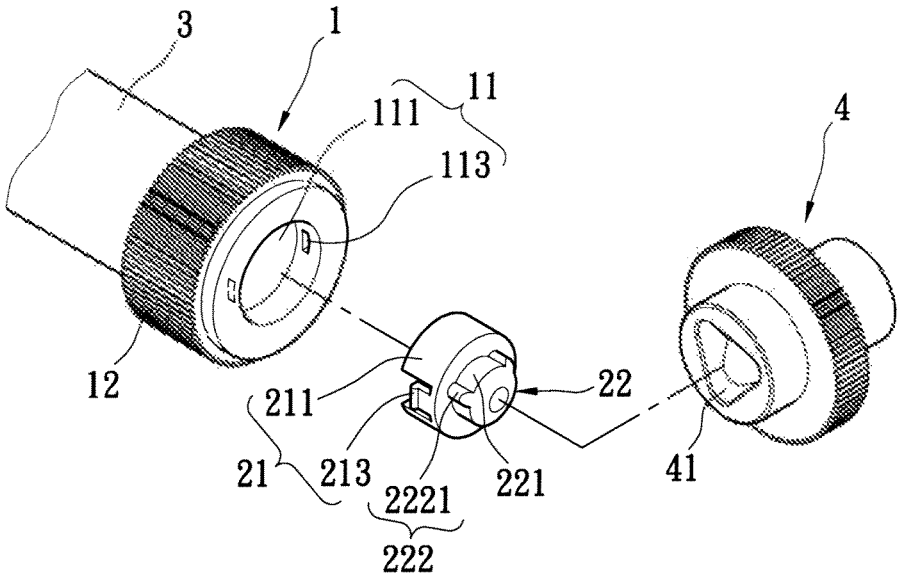
FIG. 3 shows a decomposition view of the inlay mechanism for the connection assembly in accordance with the first preferred embodiment according to the present invention.

With respect to FIG. 3, the first connection part 11 includes a groove 111, and two inlay slots 113 communicating with the groove 111. The inlay slots 113 are dented from the inner circular face, which is defined for encircling the groove 111. The second connection part 21 includes a pillar 211, and two inlay projections 213 extending from outer face of the pillar 211. The inlay projections 213 could be bumps or hooks. Therefore, the first connection part 11 and the second connection part 21 could hook up with each other for further connection. Besides, the quantity of the inlay slot 113 or the inlay projection 213 could be more than one.

Figure 4:
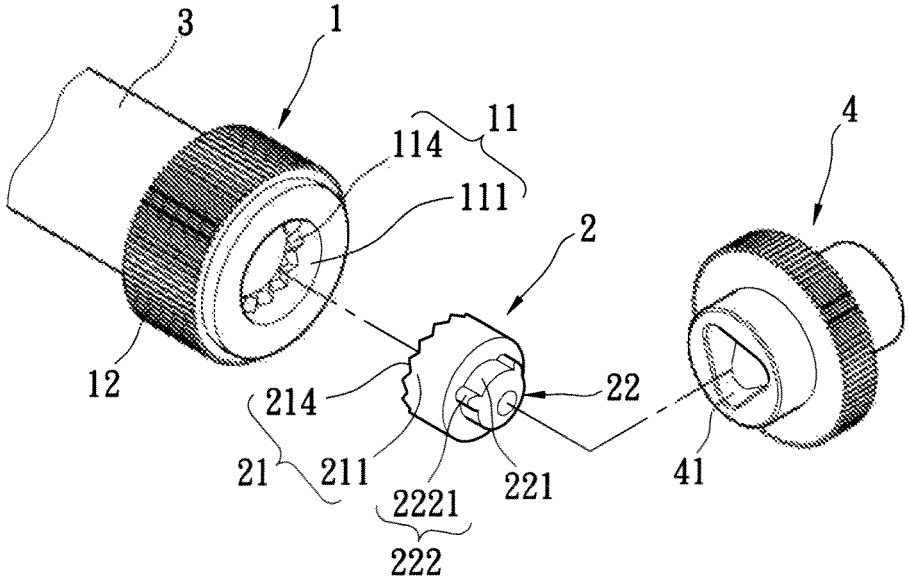
FIG. 4 shows a decomposition view of the dentate mechanism for the connection assembly in accordance with the first preferred embodiment according to the present invention.

With respect to FIG. 4, the first connection part 11 includes a groove 111 and a first dentate structure 114 formed at a bottom face, which is defined for limiting the groove 111. The second connection part 21 includes a pillar 211, and a second dentate structure 214 located at a bottom face of the pillar 211. The second dentate structure 214 corresponds to the first dentate structure 114. Therefore, the first connection part 11 and the second connection part 21 engage each other in a dentate manner.

With respect to FIG. 5, the connection assembly of the second preferred embodiment is disclosed. The different features between the second preferred embodiment and the first preferred embodiment are that the first connection part 11 includes a pillar 115 along a center line, and the second connection part 21 defines a groove 215 corresponding to the pillar 115.

Various cases of the first connection part 11 and the second connection part 21 in the second preferred embodiment are illustrated as the following but not refrained.

The second connection part 21 includes a groove 215 and two clamp slots 216 communicating with the groove 215. The clamp slots 216 are dented from an inner circular face, which is defined for encircling the groove 215, and the depth of the each clamp slot 216 is as same as that of the groove 215. The first connection part 11 includes a pillar 115, and two clamp projections 116 extending from outer face of the pillar 115. The pillar 115 corresponds to the groove 215, and the clamp projections 116 corresponds to the clamp slots 216. Therefore, the first connection part 11 and the second connection part 21 could clamp each other. Besides, the number of the clamp slot 216 or the clamp projection 116 could be one or plural.

The second connection part 21 further includes two inlay slots 217 communicating with the groove 215. The inlay slots 217 are defined between the two clamp slots 216 and dented from the inner circular face, which is defined for encircling the groove 215. The first connection part 11 further includes two inlay projections 117 extending from outer face of the pillar 115. The inlay projections 117 correspond to the inlay slots 217. The inlay projections 117 could be bumps or hooks. Therefore, the second connection part 21 and the first connection part 11 could hook up with each other for further connection.

Figure 6:
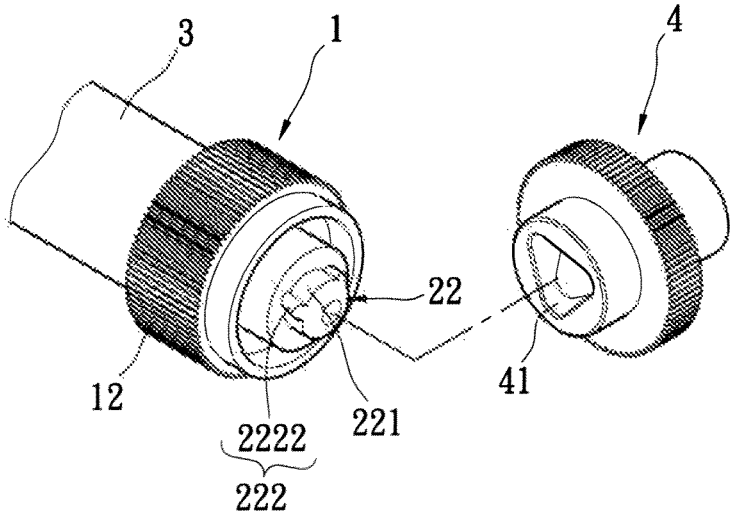
FIG. 6 shows a decomposition view of the connection assembly in accordance with the third preferred embodiment according to the present invention.

With respect to FIG. 6, the connection assembly of the third preferred embodiment is disclosed. The different features in the third preferred embodiment comparing with the first and the second preferred embodiments are that the protrusions 222 are a plurality of slant protrusions 2222. In this case, the surface of the slant protrusions 2222 is configured as spherical but not refrained. The joint end 22 inserted in the driving shaft 4, and outer peripheries of the slant protrusions 2222 abutted against the lateral wall, are defined for enclosing the pivotal slot 41. Therefore, the friction area between the slant protrusions 2222 of the connector 2 and the driving shaft 4 would be smaller, so that the connector 2 could easily insert into the driving shaft 4 to facilitate quick assembly. Besides, in this case, the pivotal slot 41 is configured as triangular but not refrained.

Moreover, the drum gear 1 and the connector 2 could be integrally formed in one piece.

There are some advantages disclosed in accordance with the present invention:

Firstly, decreasing costs: The drum gear 1 and connector 2 in accordance with the present invention are two separate and individual pieces. Thus, during the manufacture process, the defective piece of the drum gear 1 or connector 2 could be individually replaced instead of replacing both of them for achieving the goal of reducing the costs.

Secondly, reducing the quantity of the waste: Instead of replacing the defective drum gear 1 and the connector 2 together would effectively reduce the quantity of the waste which is further more environmental friendly consideration.

Thirdly, saving more maintenance expense: The detachable drum gear 1 and the connector 2 are designed according to the abrasion mechanism to the photo-conductor drum 3. Thus, instead of replacing both of them, users could just change the damaged drum gear 1 or the damaged connector 2 for saving the maintenance cost.

Fourthly, quick assembly: The friction area between the protrusions 222 of the connector 2 and the driving shaft 4 would be reduced and leads quick assembly.

The aforementioned descriptions merely represent the preferred embodiment of the present invention, without any intention to limit the scope of the present invention. Various equivalent changes, alternations or modifications based on the claims of present invention are all consequently viewed as being embraced by the scope of the present invention.

What is claimed is:

1. A connection assembly of a photo-conductor drum, applied for linking a driving shaft, comprising:

a drum gear having a first connection part arranged at an end thereof; and a connector having a second connection part arranged at an end thereof and a joint end defined an another end thereof; wherein the second connection part is correspondent with and detachably connected to the first connection part of the gear; the joint end defines a central pillar, and a plurality of protrusions extending from a periphery of the central pillar; the joint end is detachably connected to the driving shaft, wherein the first connection part includes a groove, and an inlay slot communicating with the groove; the second connection part includes a pillar, and an inlay projection extending from the pillar; the pillar corresponds to the groove, and the inlay projection corresponds to the inlay slot.

2. The connection assembly of the photo-conductor drum according to claim 1, characterized in that a clamp slot communicating with the groove; a clamp projection extending from the pillar; the clamp projection corresponds to the clamp slot.

3. The connection assembly of the photo-conductor drum according to claim 1, characterized in that number of the protrusions is three.

4. The connection assembly of the photo-conductor drum according to claim 1, characterized in that the first connection part includes a pillar, and the second connection part includes a groove; the pillar corresponds to the groove.

5. The connection assembly of the photo-conductor drum according to claim 1, characterized in that the protrusions are a plurality of spherical protrusions, the joint end is inserted in the driving shaft, and outer peripheries of the spherical protrusions abut against the driving shaft.

6. The connection assembly of the photo-conductor drum according to claim 1, characterized in that the protrusions are a plurality of slant protrusions; the joint end is inserted in the driving shaft, and outer peripheries of the slant protrusions abut against the driving shaft.

7. A connection assembly of a photo-conductor drum, applied for linking a driving shaft, comprising:

a drum gear having a first connection part arranged at an end thereof; and a connector having a second connection part arranged at an end thereof and a joint end defined an another end thereof; wherein the second connection part is correspondent with and detachably connected to the first connection part of the gear; the joint end defines a central pillar, and a plurality of protrusions extending from a periphery of the central pillar; the joint end is detachably connected to the driving shaft, wherein the first connection part includes a pillar, and a first dentate structure formed on an outer circular face of the pillar; the second connection part includes a groove, a second dentate structure formed on an inner circular face, which is defined for encircling the groove; the pillar corresponds to the groove, and the second dentate structure corresponds to the first dentate structure.

8. A connection assembly of a photo-conductor drum, applied for linking a driving shaft, comprising:

a drum gear having a first connection part arranged at an end thereof; and a connector having a second connection part arranged at an end thereof and a joint end defined an another end thereof; wherein the second connection part is correspondent with and detachably connected to the first connection part of the gear; the joint end defines a central pillar, and a plurality of protrusions extending from a periphery of the central pillar; the joint end is detachably connected to the driving shaft, wherein the first connection part includes a pillar, and a clamp projection extending from the pillar; the second connection part defines a groove, and a clamp slot communicating with the groove; the pillar corresponds to the groove, and the clamp projection corresponds to the clamp slot.

* * * * *